US010973269B2

(12) United States Patent
Moritz

(10) Patent No.: US 10,973,269 B2
(45) Date of Patent: Apr. 13, 2021

(54) BELT, BUCKLE COUPLED WITH A STRAP TO FORM THE BELT AND STRAP COUPLED WITH THE BUCKLE TO FORM THE BELT

(76) Inventor: Randi Hollyn Moritz, Virginia Beach, VA (US)

( * ) Notice: Subject to any disclaimer, the term of this patent is extended or adjusted under 35 U.S.C. 154(b) by 0 days.

(21) Appl. No.: 13/991,519

(22) PCT Filed: Oct. 11, 2011

(86) PCT No.: PCT/IB2011/054483
§ 371 (c)(1),
(2), (4) Date: Jun. 4, 2013

(87) PCT Pub. No.: WO2012/049626
PCT Pub. Date: Apr. 19, 2012

(65) Prior Publication Data

US 2013/0283501 A1 Oct. 31, 2013

(30) Foreign Application Priority Data

Oct. 11, 2010 (IT) ..... BO2010A000608

(51) Int. Cl.

| | |
|---|---|
| ***A61F 9/00*** | (2006.01) |
| ***A44B 11/22*** | (2006.01) |
| ***A41F 9/00*** | (2006.01) |
| *A44B 11/24* | (2006.01) |

(52) U.S. Cl.
CPC ..... *A41F 9/00* (2013.01); *A41F 9/002* (2013.01); *A44B 11/22* (2013.01); *A44B 11/24* (2013.01); *Y10T 24/406* (2015.01)

(58) Field of Classification Search
CPC .. A41F 9/002; A41F 9/02; A41F 9/025; A41F 11/00; A41F 13/00; A41F 1/008;
(Continued)

(56) References Cited

U.S. PATENT DOCUMENTS 154,673 A * 9/1874 Higinbotom ..... A44B 11/22 24/164
1,445,075 A * 2/1923 Erpenbeck ..... A44B 11/20 24/186

(Continued)

FOREIGN PATENT DOCUMENTS

AU 4749693 3/1994
DE 9419623 U1 1/1995

(Continued)

*Primary Examiner* — Alissa J Tompkins
*Assistant Examiner* — Catherine M Ferreira
(74) *Attorney, Agent, or Firm* — Stein IP, LLC

(57) ABSTRACT

A belt comprises a strap (10) extending between a first end portion (10*a*) and a second end portion (10*b*) along a respective principal direction of extension (A) and comprising a plurality of through locking holes (11) arranged one after another and at least one through fastening opening (15). The belt also comprises a buckle (2), which can be removably coupled with the strap (10), comprising a main body (3) and at least one tongue (4) connected to an inner face (3*b*) of the main body (3) and projecting from it to form a free end (4*b*) which can engage in at least one of the through locking holes (11) in the strap (10) The buckle (2) also comprises a fastening element (5) protruding from the inner face (3*b*) of the main body (3) and configured for removably coupling with each other the buckle (2) and the strap (10) The fastening element (5) comprises a portion of maximum width (5*a*) having a predetermined shape and sized to match the fastening opening (15) in the strap (10).

20 Claims, 4 Drawing Sheets

(58) Field of Classification Search
CPC ..... A41F 17/02; A41F 17/04; A41F 19/00; A41F 1/00; A41F 1/002; A41F 3/00; A41F 9/00; A41F 5/00; A41F 11/16; A41F 11/18; A41F 17/00; A41F 18/00; A41F 3/02; A41F 3/04; A41F 9/005; A43C 11/146; A43C 11/1486; A44C 13/00; A44C 15/003; A44C 25/00; A44C 25/001; A44C 25/005; A44C 5/0069; A45C 13/10; A45F 2003/146; A45F 3/00; A44B 11/24; A44B 11/006; A44B 11/22; A44B 11/2549; A44B 11/2557; A44B 19/02; A44B 19/262; A44B 1/04; A44B 1/18
USPC ..... 2/321; 24/176, 177, 312, 323, 324, 182, 24/186
See application file for complete search history.

(56) References Cited

U.S. PATENT DOCUMENTS 1,682,450 A * 8/1928 Wanninger et al. ..... 24/323
2,049,414 A * 8/1936 Cohen ..... 2/322
2,419,662 A * 4/1947 Sutton ..... A44B 11/22 24/176
2,783,516 A * 3/1957 Stein ..... A44B 11/22 24/176
3,913,147 A * 10/1975 Ostrander ..... A44B 11/22 2/311
4,477,949 A * 10/1984 Calabro ..... 24/180
5,127,136 A * 7/1992 Magnus ..... A44B 11/226 24/176
6,412,148 B1 * 7/2002 Morris ..... 24/176
8,522,405 B2 * 9/2013 Spielberger ..... A44B 11/20 2/311
2007/0094776 A1 * 5/2007 Stevens ..... A41F 9/002 2/338
2011/0107562 A1 * 5/2011 Spielberger ..... A44B 11/20 24/186

FOREIGN PATENT DOCUMENTS

FR 1376719 A 10/1964
GB 605074 A 7/1948

* cited by examiner

BELT, BUCKLE COUPLED WITH A STRAP TO FORM THE BELT AND STRAP COUPLED WITH THE BUCKLE TO FORM THE BELT

This application is a National Stage Entry of International Application No. PCT/IB2011/054483, filed Oct. 11, 2011, and claims the benefit of Italian Application No. BO2010A000608 filed Oct. 11, 2010, both of which are hereby incorporated by this reference.

TECHNICAL FIELD

This invention relates to a belt, a buckle coupled with a strap to form the belt and a strap coupled with the buckle to form the belt.

The invention applies in particular to the field of fashion and apparel, especially to the accessories market.

It should be noted that the term "belt" is not used to apply only to accessories worn round the waist but more generally to any accessory having a buckle and a strap which can be coupled with each other, be it a bracelet, a necklace or the like.

This specification, however, refers in particular to a belt worn round the waist or hips of a user but without thereby limiting the scope of the invention.

BACKGROUND ART

Known in the prior art are belts which comprise a strap and a buckle connected removably to each other so that one or the other can be changed to obtain multiple shape and colour combinations.

In particular, document AU4749693 describes a belt buckle comprising a main body and a pair of protrusions or tongues arranged in line one after the other. A first protrusion is permanently attached to a perforated end of a strap, while a second protrusion can be removably fastened to the opposite end of the strap.

The free end of each protrusion is bulbous and slightly larger in size than the holes in the strap.

Also, the first protrusion is inclined at an angle to the second protrusion so it can be attached more securely to the respective end of the strap.

Another prior art technical solution is described in patent document U.S. Pat. No. 3,913,147.

This solution comprises a belt with a strap and a buckle which are removably attached to each other.

The strap has a first and a second end. The first end has a hole running through it and the second end may have a plurality of holes running through it.

The buckle allows the first end to be attached to the second end.

More specifically, the buckle comprises a tongue or locking means protruding from one side of the buckle and having at a free end of it a hook portion designed to connect the second end of the strap.

The locking means also has at an intermediate region of it, an enlarged portion extending radially and adapted to make the connection with the first end of the strap more secure.

Disadvantageously, in the solutions provided by the prior art, detaching the buckle from the strap is awkward.

In effect, in both the solutions described, the buckle tongue has a bulbous or enlarged portion which is larger in size than the corresponding hole in the strap.

Moreover, continual stresses applied by the bulbous portion on the hole when the buckle and strap are unfastened may eventually cause the hole to go out of shape, making connection between the buckle and the strap less secure.

DISCLOSURE OF THE INVENTION

The aim of this invention is to provide a belt, a buckle coupled with a strap to form the belt and a strap coupled with the buckle to form the belt which overcome the above mentioned disadvantages of the prior art.

More specifically, the aim of the invention is to provide a belt that is easy to unfasten.

Another aim of the invention is to provide a belt where the fastening between the strap and the buckle is highly secure.

A further aim of the invention is to provide a buckle that simplifies unfastening of the belt.

A yet further aim of the invention is to obtain a buckle that makes its fastening to the strap particularly secure.

A still further aim of the invention is to obtain a strap that is easy to substitute.

These aims are fully achieved by the belt according to the invention as characterized in the appended claims and, more specifically, in that the buckle comprises a fastening element with a portion of maximum width having a predetermined shape and substantially sized to match a fastening opening in the strap.

The aims are also fully achieved by the buckle according to the inventions as characterized in the appended claims and, more specifically, in that the fastening element has a portion of maximum width with a predetermined shape and in that the projection of the portion of maximum width on an inner face of a central body subtends an area which is larger, preferably at least five times larger, than the area subtended by the projection of the free end of the tongue on the inner face.

The aims are also achieved by the strap according to the invention as characterized in the appended claims and, more specifically, in that the fastening opening defines a gap which is greater in area than the gaps defined by the through locking holes.

BRIEF DESCRIPTION OF THE DRAWINGS

This and other features are described in more detail below with reference to a preferred, non-limiting example embodiment, with reference to the accompanying drawings, in which.

DETAILED DESCRIPTION OF THE PREFERRED EMBODIMENTS OF THE INVENTION

Figure 1:
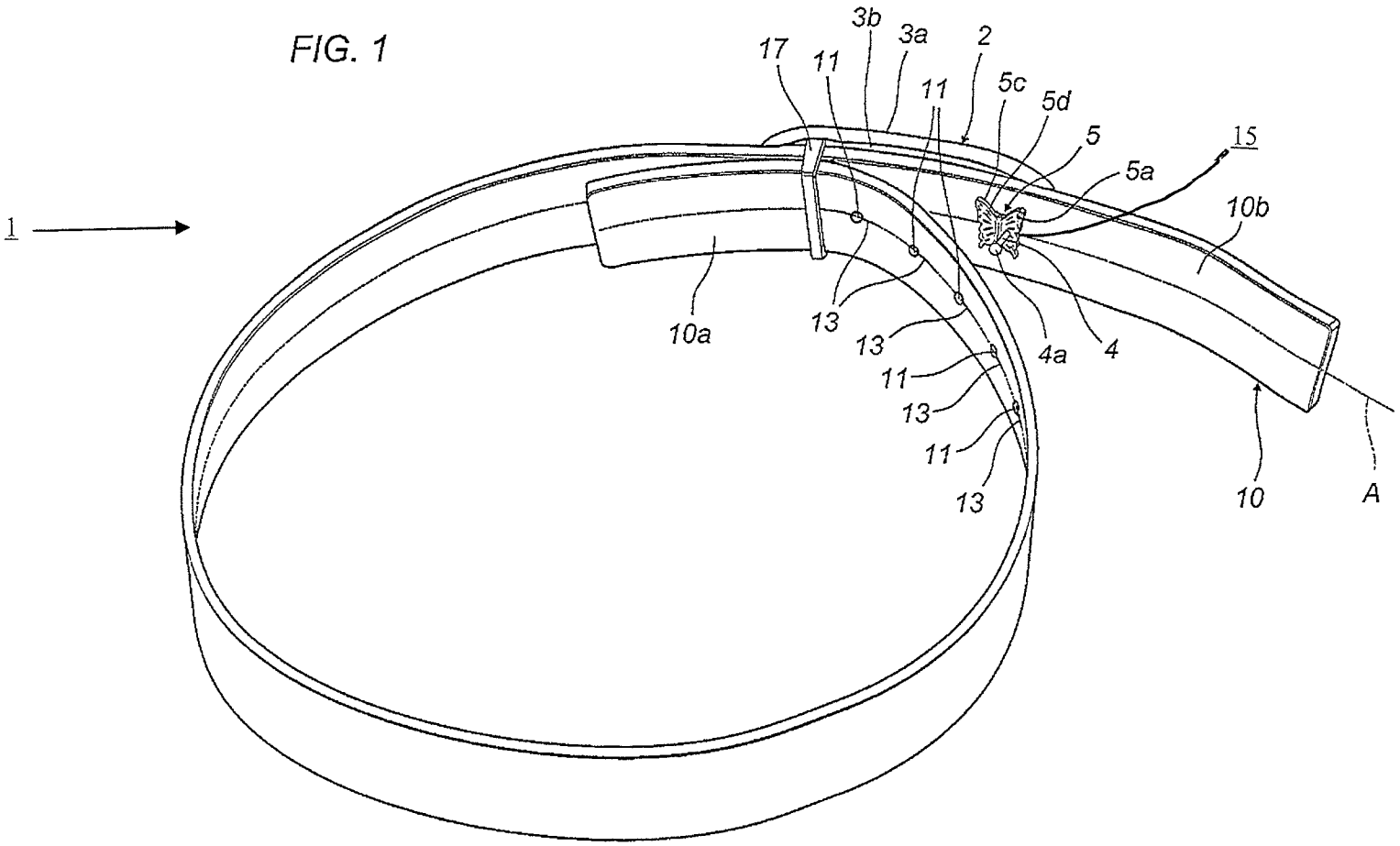
FIG. 1 shows a schematic perspective view of a belt according to this invention in a first configuration.
Figure 2:
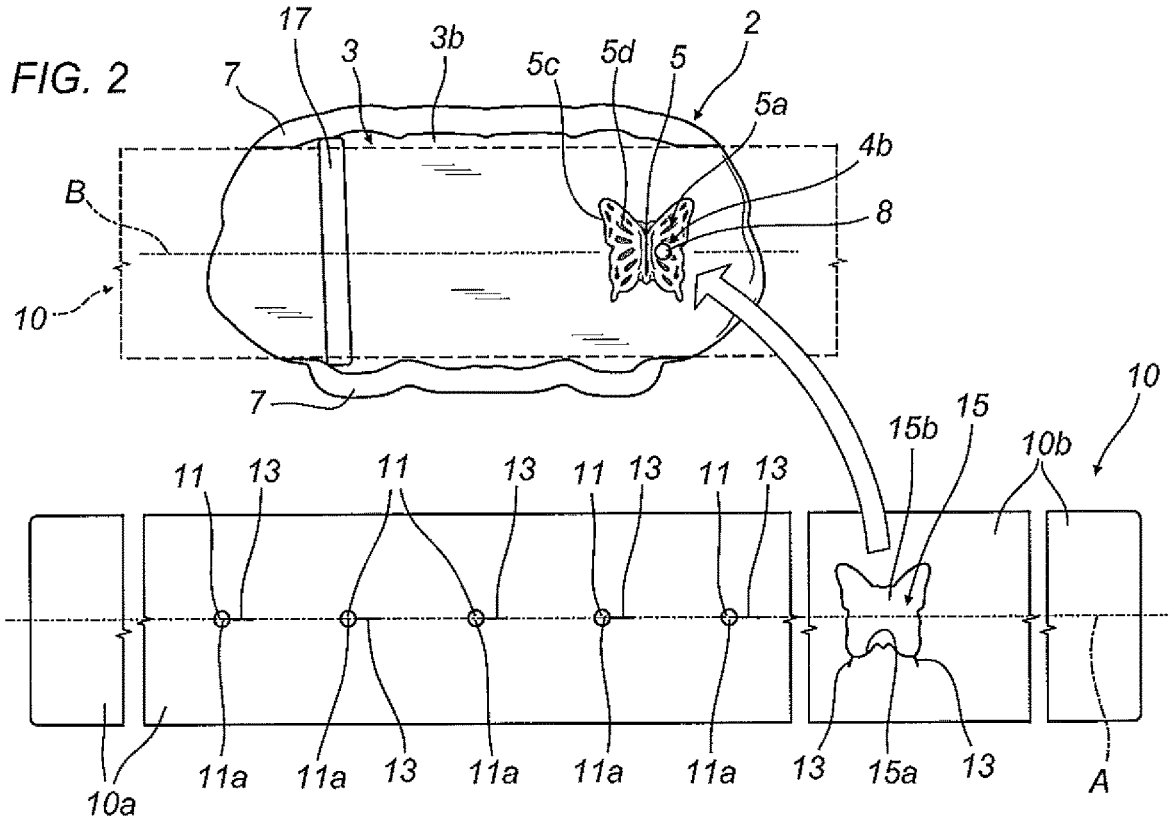
FIG. 2 shows a first embodiment of a belt and buckle according to the invention, with some parts removed in order to better illustrate others.

With reference to the accompanying drawings, the numeral 1 denotes a belt according to the invention.

The belt 1 comprises a buckle 2 and a strap 10, which are also objects of the invention.

It should be noticed that the belt 1 is of a modular type, that is to say, of a type where the buckle 2 and the strap 10 are interchangeable with each other.

In other words, the buckle 2 and the strap 10 can be removably coupled with each other.

More specifically, the strap 10 extends between a first end of it 10*a* and a second end of it 10*b* along a principal direction of extension "A".

Preferably, the strap 10 is made of leather or other animal skin.

Alternatively, the strap may be made of cord or like material.

In other words, it is particularly important, for reasons that will become clearer as this description continues, that the strap 10 be made of a material which is deformable.

In the embodiment illustrated, the strap has a substantially constant thickness "S" throughout its full length.

Alternatively, different parts of the strap might differ in thickness.

The strap 10 further comprises at least one through locking hole 11 located preferably in the proximity of the first end portion 10*a* of the strap.

More preferably, the strap 10 comprises a plurality of through locking holes 11 located, preferably in line, one after the other along the principal direction of extension "A".

The through locking holes 11 are located in the proximity of the first end portion 10*a* and extend away from it.

Each of the holes 11 defines a gap 11*a* that runs through the strap 10.

In use, the through locking holes 11, as is known, allow the belt 1 to be adjusted according to the wearer's size or the position where he/she wishes to wear it, by engaging with a corresponding tongue 4 forming part of the buckle 2, described in more detail below.

Further, the strap 10 has a through fastening opening 15 located in the proximity of the second end portion 10*b*.

The opening 15 is adapted to engage with a respective fastening element 5 forming part of the buckle 2 and has a predetermined shape and is sized to match at least part of the fastening element 5.

Further, the opening 15 is defined at its perimeter by an edge or inside wall 15*a* having a series of projections and recesses.

Still more preferably, the inside wall 15*a* has an irregular shape.

In other words, the inside wall 15*a* is substantially uneven.

Preferably, the opening 15 defines a gap 15*b* which is larger in area than the gaps 11*a* defined by the through locking holes 11.

The advantage of this feature will become more apparent as this description continues.

Preferably, the strap 10 has at least one slit 13 at each through locking hole 11 and/or opening 15 to facilitate insertion and/or extraction of the tongue 4 and/or of the fastening element 5.

The slits 13 are particularly advantageous at the through locking holes 11 because they reduce the deformation applied to the selfsame through locking hole 11 by the tongue 4, as will become clearer as this description continues.

As already stated, the buckle 2 can be coupled with the strap 10 to form the belt 1.

The buckle 2 comprises a main body 3 from which the tongue 4 and the fastening element 5 protrude.

Preferably, the main body 3 has a substantially plate shaped structure.

In other words, one of the dimensions of the main body 3 is substantially negligible compared to its other two dimensions.

The main body 3 thus has an outer face 3*a* and an inner face 3*b* on opposite sides of it.

Further, the main body 3 has a principal direction of extension "B" along which the strap 10 is positioned in use.

It should be noted that when the strap 10 and the buckle 2 are coupled, the principal direction of extension "A" of the strap 10 corresponds to the principal direction of extension "B" of the buckle 2.

More specifically, the first face 3*a*, or outer face, has a mainly ornamental function and is intended to be visible when the belt 1 is being worn.

Generally speaking, the outer face 3*a* is particularly important for the aesthetic quality of the belt 1.

For this purpose, the outer face 3*a* may be worked or decorated in such a way as to give it a distinctive and predetermined shape or relief pattern.

The second face 3*b*, or inner face, on the other hand, has a mainly functional purpose and, when the belt is being worn, is directed towards the wearer's body.

The tongue 4 and the fastening element 5 protrude from the inner face 3*b*.

Preferably, the inner face 3*b* has a concave shape and has a limited curvature along the principal direction of extension "B".

Still more preferably, the curvature radius of the inner face is much larger than the dimensions of the buckle 2 itself.

In other words, the curvature of the inner face 3*b* is very limited.

Advantageously, that means the buckle 2 can at least partly follow the curvature of the strap 10 when the belt 1 is in a closed configuration.

The main body 3 also has a pair of raised lateral edges 7 running along the principal direction of extension "B" at a peripheral portion of the main body 3 itself.

Preferably, the raised lateral edges protrude from the inner face 3*b*.

Advantageously, that way, the raised lateral edges 7 act as guides for the strap 10, preventing its misalignment which, besides being potentially unattractive, might lead to problems of coupling the buckle 2 and the strap 10.

As already mentioned, the tongue 4 protrudes from the inner face 3*b* of the main body 3 and extends away from it between a first end of it, or connecting end 4*a* where it joins the main body 3, and a second end of it, or free end 4*b*.

The tongue 4 extends away from the main body 3 along its own principal axis "C".

Preferably, the free end 4*b* of the tongue 4 can engage in at least one of the through locking holes 11 in the strap 10.

Further, the free end 4*b* is configured to be inserted through the opening 15 with clearance.

In other words, the free end 4*b* is sized to go through the opening 15 without coming into contact with the edge, or inner wall, 15*a* of the opening.

In the embodiment illustrated, the tongue 4 is at least partly defined by a rod shaped element, or stem 9, which extends transversely to the main body 3, along the axis "C".

More in detail, the cross section of the stem 9 transversal to the axis "C" is less than or equal to the gap 11*a* defined by the through locking holes 11.

Preferably, at the free end of it 4*b*, the tongue 4 has a bulbous portion 8 which can be engaged with at least one of the through locking holes 11 in the strap 10.

In the embodiment illustrated, the tongue 4 is therefore in the form of a stem 9 with a bulbous portion 8 at the top end of it.

It should be noticed that the radial extension of the bulbous portion 8 is larger than that of the stem 9.

In other words, transversely to the axis "C", a cross section of the bulbous portion 8 of maximum width occupies an area which is larger than the cross section of the stem 9.

In order to facilitate the coupling of each through locking hole 11 and the tongue 4, the radial extension of the bulbous portion 8 is also larger than the radial extension of the hole 11.

In other words, the bulbous portion 8 is sized to be inserted through each through locking hole 11 with interference.

In an alternative embodiment (not illustrated), the engageable element is a hook-shaped end of the tongue.

Preferably, the tongue 4 is inclined with respect to the inner face 3*b* of the main body 3 in such a way as to make an angle therewith, preferably of slightly less than 90 degrees.

More specifically, the tongue 4 is inclined in a direction opposite the direction in which the strap 10 applies a pulling action when the belt 1 is in the closed configuration.

As mentioned above, the buckle 2 also comprises a fastening element 5 protruding from the main body for removably coupling the buckle 2 and the strap 10.

In other words, the fastening element 5 protrudes from the inner face 3*b* of the main body 3 transversely thereto.

The fastening element 5 has a portion of maximum width 5*a* adapted to physically fasten the buckle 2 to the strap 10, and a portion 5*b* for connection to the main body 3.

Thus, to all intents and purposes, the portion of maximum width 5*a* is an active portion because it acts physically on the strap 10 during fastening.

It should be noted that the expression "portion of maximum width 5*a*" is used to mean the portion of the fastening element 5 whose projection on the inner face 3*b* of the main body 3 subtends an area which is greater than or equal to that of other portions of the fastening element 5.

The portion of maximum width 5*a* has a predetermined shape and is substantially sized to match the through fastening opening 15 in the strap 10.

Advantageously, that makes it possible to unfasten the strap 10 and the buckle 2 without having to deform the strap 10.

Moreover, the matching shape also creates friction between the portion of maximum width 5*a* and the inner wall 15*a* of the opening 15, thus preventing the buckle 2 from becoming detached from the second end portion 10*b* of the strap 10.

It should be noted that the portion of maximum width 5*a* and the opening 15 may have any of a wide variety of shapes.

Preferably, and in the same way as the opening 15, the portion of maximum width 5*a* is defined at its perimeter by an edge 5*c* having a series of projections and recesses.

Still more preferably, the edge 5*c* has an irregular shape.

In other words, the edge 5*c* is substantially uneven.

Advantageously, that increases the grip between the edge 5*c* itself and the strap 10 at the opening 15.

More specifically, the edge 5*c* defines a plurality of grip teeth which increase the effectiveness of the coupling.

In a first illustrated embodiment, the portion of maximum width 5*a* and the opening 15 have the shape of a butterfly.

Figure 3:
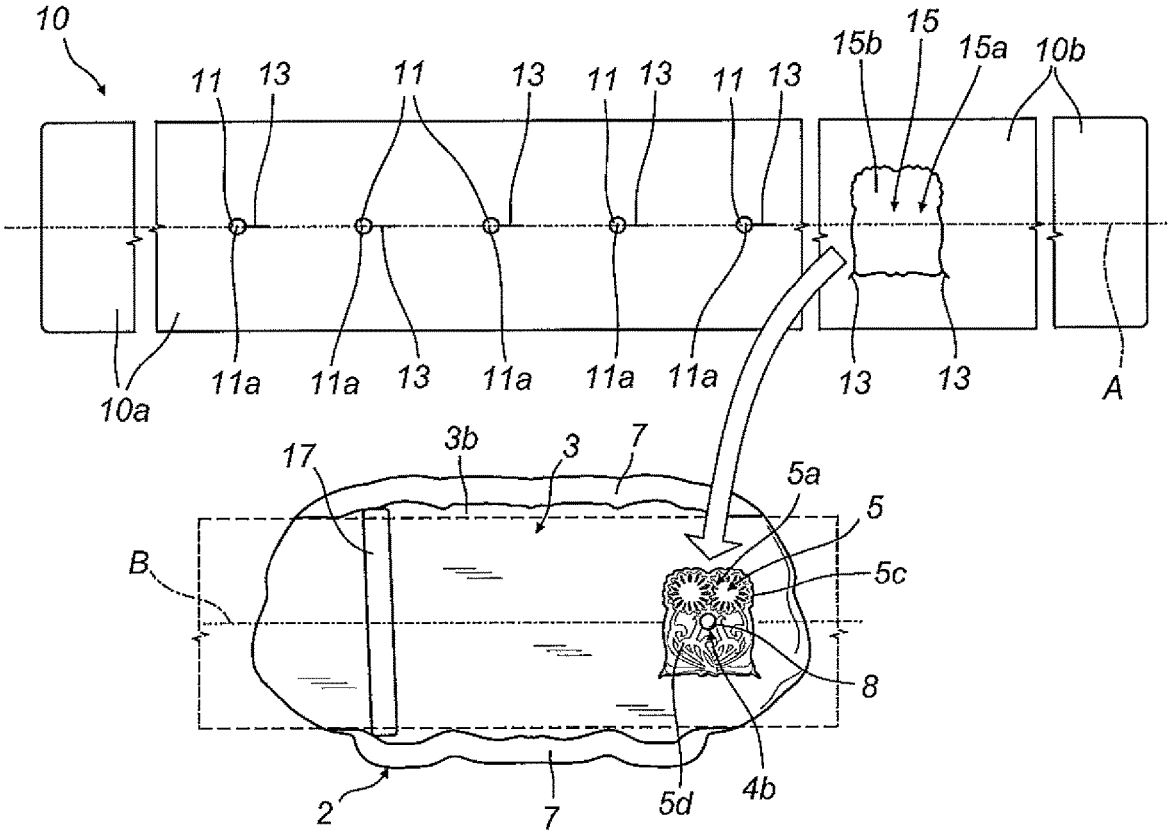
FIG. 3 shows a second embodiment of a belt and buckle according to the invention, with some parts removed in order to better illustrate others.
Figure 4:
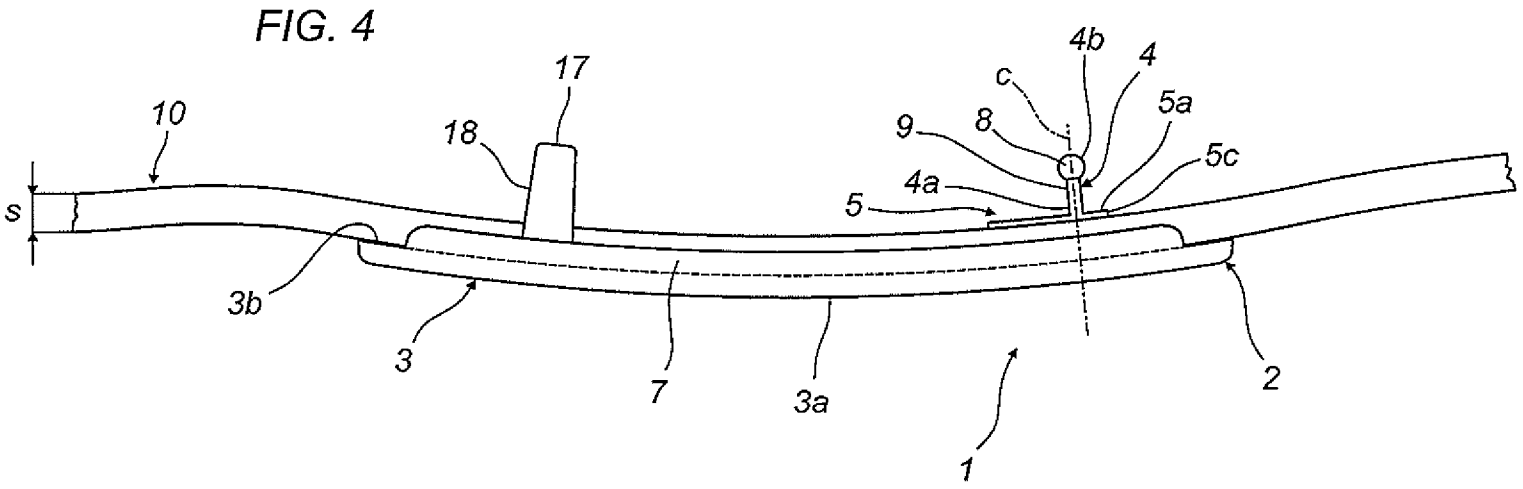
FIG. 4 shows a side view of a detail of the belt of FIG. 1.
Figure 5:
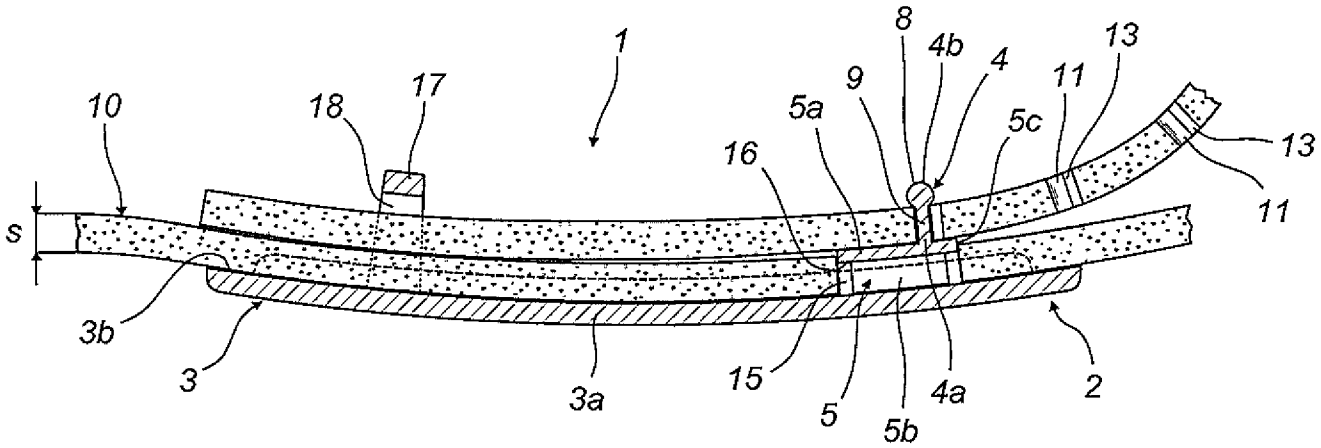
FIG. 5 shows a cross section of the detail of FIG. 4.

The portion of maximum width 5*a* and the opening 15 may, however, be shaped in any of a variety of different ways (FIG. 3).

Preferably, also, the shape of the portion of maximum width 5*a* matches a decoration made on the first face, or outer face 3*a*, of the main body 3.

The connecting portion 5*b* of the fastening element 5 is interposed between the portion of maximum width 5*a* and the main body 3.

Preferably, the connecting portion 5*b* subtends an area which is smaller than that of the portion 5*a* of maximum width.

In other words, the projection of the portion of maximum width 5*a* on the inner face 3*b* of the central body 3 subtends an area which is greater than the area subtended by the projection of the connecting portion 5*b* on the inner face 3*b*.

Thus, there is a step 16 between the portion of maximum width 5*a* and the connecting portion 5*b*.

In other words, the portion of maximum width 5*a* protrudes radially from the connecting portion 5*b*.

Advantageously, although this considerably increases the grip between the buckle 2 and the strap 10, unfastening the belt 1 remains quick and easy.

In effect, the matching shape of the opening 15 and the portion of maximum width 5*a* means that the user can easily detach the second end portion 10*b* of the strap 10 from the buckle 2 by applying a force transversal to the opening 15 and the portion of maximum width 5*a*.

On the other hand, any tangential action, however slight, that is to say, any action that has a component in a direction parallel to the plane of the opening 15 or of the portion of maximum width 5*a* causes the inner wall 15*a* of the opening to be deformed on account of pressure against the step 16, thereby preventing the strap 10 and the buckle 2 from being unfastened.

Considering, moreover, that such tangential actions are typical of the belt 1 when it is being worn, accidental unfastening of the second end portion 10*b* of the strap 10 from the buckle 2 is easily prevented.

Preferably, the difference between the area subtended by the connecting portion 5*b* and the area of the portion of maximum width 5*a* is much less than the value of those areas.

More precisely, the two areas are comparable and differ in a peripheral frame enclosed between the two.

In a first embodiment, the connecting portion 5*b* is defined by a plurality of feet which connect the portion of maximum width 5*a* and the main body 3.

Alternatively, the connecting portion may be a single block interposed between the portion of maximum width 5*a* and the main body 3.

Preferably, also, the distance between the portion of maximum width 5*a* and the main body 3, more specifically, inner face 3*b*, is less than or equal to the aforementioned thickness "S" of the strap 10, at least in the proximity of the opening 15.

Advantageously, this prevents loose fitting between the portion of maximum width 5*a* and the opening 15 and, more specifically, prevents the opening 15 and the portion of maximum width 5*a* from going out of alignment, thus preventing their unfastening.

In other words, there can thus be no relative movement between the strap 10 and the main body 3.

Preferably, the radial extension of the free end 4*b* of the tongue 4 defines a smaller area than the portion of maximum width 5*a*.

In other words, the projection of the portion of maximum width 5*a* on the inner face 3*b* of the central body 3 subtends an area which is greater than the area subtended by the projection of the free end 4*b*, and more specifically, of the bulbous portion 8, on the inner face 3*b*.

In the preferred embodiment, the projection of the portion of maximum width 5*a* on the inner face 3*b* of the central body 3 subtends an area which is at least five times greater than the area subtended by the projection of the free end 4*b*, on the inner face 3*b*.

Preferably, the tongue 4 and the fastening element 5 are rigidly connected and superposed.

More specifically, the tongue 4 is superposed over the fastening element 5.

Thus, the first end 4*a* of the tongue 4 is rigidly connected to the fastening element 5.

In the embodiment illustrated, the tongue 4 protrudes from the portion of maximum width 5*a* of the fastening element 5.

Preferably, the distance between the free end 4*b* of the tongue 4 and the inner face 3*b* of the main body 3 substantially corresponds to twice the thickness "S" of the strap 10.

More specifically, the distance between the free end 4*b* of the tongue 4 and a top face 5*d* of the portion of maximum width 5*a* of the fastening element 5 is approximately half the distance between the selfsame free end 4*b* and the inner face 3*b* of the main body 3.

Advantageously, that way, when the belt 1 is in the closed configuration, the first end portion 10*a* of the strap 10 contributes to keeping the second end portion 10*b* of the strap 10 coupled with the portion of maximum width 5*a* of the fastening element 5.

The buckle 2 also comprises a ring 17 protruding from the inner face 3*b* of the main body 3.

Preferably, the ring 17 and the fastening element 5 are located on opposite sides of the inner face 3*b* of the main body 3.

The ring 17 defines an aperture 18 for the passage of the strap.

In other words, the ring 17 acts as a loop for the strap 10 and helps keep the strap in the correct position for use.

Preferably, the distance between a crosspiece of the loop 17 and the main body 3, in particular the inner face 3*b* thereof, is greater than twice the thickness "S" of the strap 10.

Figure 6:
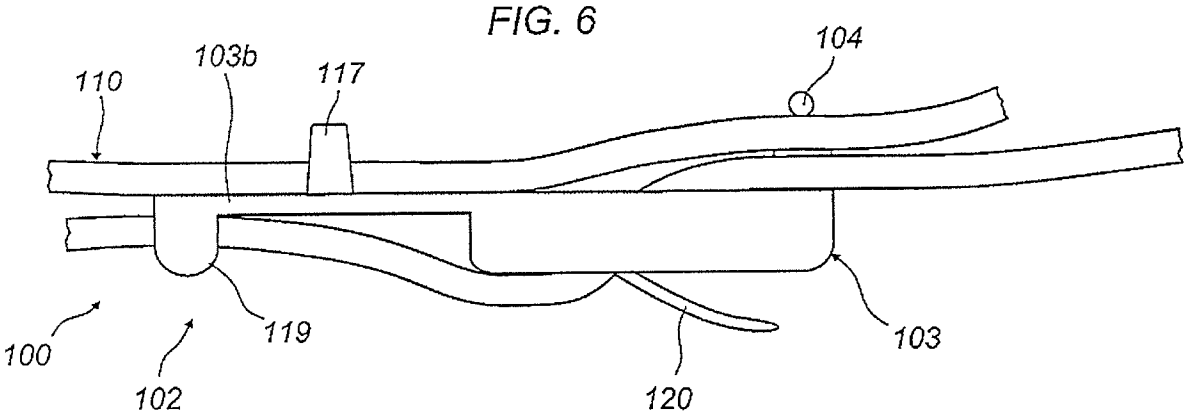
FIGS. 6 and 7 show a side view and the corresponding cross section of another embodiment of the belt according to the invention.
Figure 7:
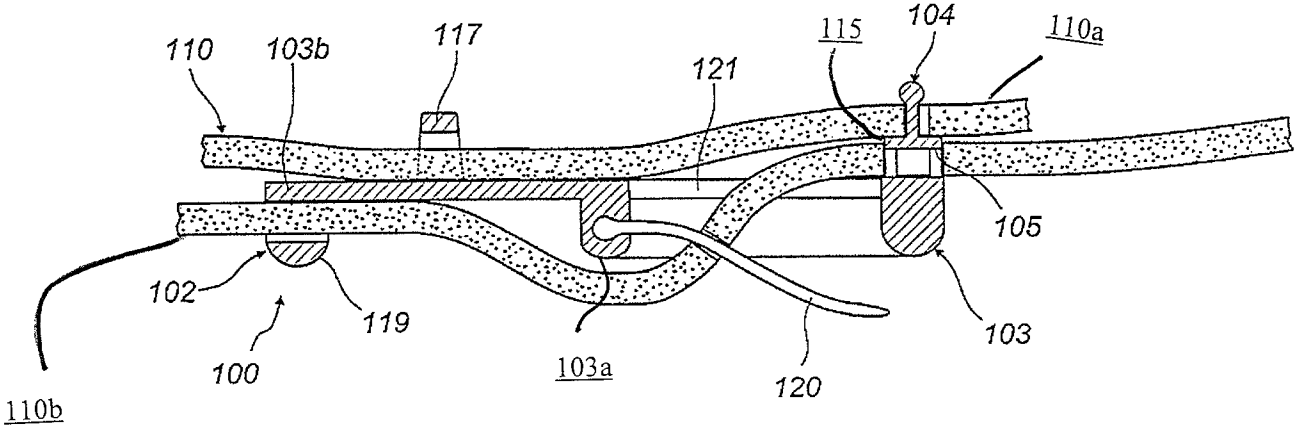

With reference to FIGS. 6 and 7, the numeral 100 denotes another embodiment of the belt according to the invention with a first end 110*a* and a second end 110*b*.

In this embodiment, the buckle 102 has a through slot 121 (or opening) which puts the inner face 103*b* in communication with the outer face 103*a* of the main body 103.

As in the embodiment described above, the inner face 103*b* of the main body 103 has, protruding from it, a fastening element 105 and a tongue 104.

Again as in the embodiment described above, the tongue 104 is preferably superposed over the fastening element 105.

In this embodiment (FIGS. 6, 7), the slot 121 serves as a passage for the second end portion 110*b* of the strap 110.

In the embodiment illustrated, the main body 103 is partly defined by a frame within which the slot 121 is defined.

Alongside the frame, the main body 103 preferably comprises a bridge portion 119 protruding from the outer face 103*a* of the main body 103 itself.

The bridge portion 119 acts as a slot for the passage of the second end portion 110*b*.

Preferably, the bridge portion 119 comprises a crosspiece whose distance from the outer face 103*a* of the main body 103 substantially corresponds to the thickness of the strap 110, at least at the second end portion 110*b*.

Preferably, with reference to the principal direction of extension "B" of the main body 103, the bridge portion 119 and the fastening element 105 are on opposite sides of the main body 103 itself.

Preferably, a further tongue 120 is rotatably connected to one edge, or first side, of the frame 121.

More in detail, the further tongue 120 is rotatable in a plane parallel to the principal direction of extension "B" of the main body 103.

In still more detail, the further tongue 120 is rotatable towards in a plane transversal to the plane in which the slot 121 extends.

More specifically, the further tongue 120 is rotatable towards and/or away from a second side of the slot 121, opposite the first side.

For this purpose, in this embodiment, the strap 110 has at least one further through hole 122 which, in use, the further tongue 120 is inserted through.

Preferably, the strap 110 has a plurality of further holes 122 aligned with each other.

In the embodiment illustrated, the further holes 122 start at the fastening opening 115 and extend towards an end zone of the second end portion 110*b* of the strap 110 itself.

In the embodiment illustrated, the fastening element 105 protrudes from the inner face 103*b* of the main body 103 on the second side of the slot 121.

Also protruding from the inner face 103*b* of the main body 103 there is a ring 117.

Preferably, the ring has a crosspiece whose distance from the inner face 103*b* of the main body 103 substantially corresponds to the thickness "S" of the strap 110.

Preferably, the ring 117 and the fastening element 105 protrude from opposite sides of the inner face 103*b* of the main body 103.

The invention achieves the above mentioned aims and brings important advantages.

In effect, the presence of a fastening element having a portion of maximum width that is shaped to match the corresponding opening in the strap allows the strap to be easily pulled out of the buckle without effort by the user or deformational stress on the strap itself.

Further, the presence of the step, that is to say, of a connecting portion between the portion of maximum width of the fastening element, subtending an area smaller than the portion of maximum width makes the fastening between strap and buckle more secure.

Moreover, the fact that the portion of maximum width and thus the opening in the strap have an irregular and uneven perimeter increases the grip between strap and buckle, since the protrusions of the portion of maximum width grip the inner wall of the opening when the action applied is not perfectly transversal.

Lastly, the presence of a tongue and a fastening element which are superposed over each other makes the belt more functional and, more specifically, increases the stability of the fastening since the first end portion of the strap contributes to holding the second end portion of the strap in place when the belt is in the closed configuration.

The invention claimed is:

1. A belt comprising:

a strap extending between a first end and a second end, the strap, having a thickness and comprising at least one locking hole extending through the strap and at least one fastening opening also extending through the strap;

a buckle, removably coupled to the strap only by first and second elements, the buckle comprising:

a substantially plate shaped main body with a first and second face, a first fastening element comprising a tongue supported by said first face of said main body and projecting away from said main body to form a free end to engage the locking hole in the strap, a second fastening element protruding from the first face of said main body for removably coupling the buckle and the strap;

wherein the second fastening element comprises a first portion having a predetermined shape and sized to match the fastening opening in the strap.

2. The belt according to claim 1, wherein said fastening opening has a shape and said locking hole has a shape which is different from said shape of said fastening opening.

3. The belt according to claim 1, wherein said fastening opening and said locking hole have different areas.

4. The belt according to claim 1, wherein said fastening opening and said locking hole have different shapes and areas.

5. The belt according to claim 1, wherein the first portion of the second fastening element and the fastening opening in the strap have respective perimeters, the perimeters of each of the first portion of the second fastening element and the fastening opening having a corresponding series of projections and recesses.

6. The belt according to claim 1, wherein a projection of the first portion of the second fastening element on the first face of the main body subtends an area which is at least three times greater, than the area subtended by the projection of a free end of the tongue on the first face.

7. The belt according to claim 3, wherein the tongue is rigidly superposed on the second fastening element and extends from the first portion of the second fastening element, the strap comprising a single fastening opening.

8. The belt according to claim 1, wherein a distance between the free end of the tongue and the first face of the main body is substantially double the thickness of the strap.

9. The belt according to claim 2, wherein a distance between the free end of the tongue and the first face of the main body is substantially double the thickness of the strap.

10. The belt according to claim 3, wherein a distance between the free end of the tongue and the first face of the main body is substantially double the thickness of the strap.

11. The belt according to claim 4, wherein a distance between the free end of the tongue and the first face of the main body is substantially double the thickness of the strap.

12. The belt according to claim 1 wherein the tongue protrudes from and is supported by the second fastening element.

13. The belt according to claim 2, wherein the first portion of the second fastening element is connected to the main body by a connecting portion, a projection of the connecting portion on the first face of the main body subtending an area which is less than an area subtended by the projection of the first portion on the first face.

14. The belt according to claim 3, wherein the first portion of the second fastening element is connected to the main body by a connecting portion, a projection of the connecting portion on the first face of the main body subtending an area which is less than an area subtended by the projection of the first portion on the first face.

15. The belt according to claim 4, wherein the first portion of the second fastening element is connected to the main body by a connecting portion, a projection of the connecting portion on the first face of the main body subtending an area which is less than an area subtended by the projection of the first portion on the first face.

16. The belt according to claim 1, wherein the strap comprises a plurality of locking holes arranged one after another close to the first end.

17. The belt according to claim 2, wherein the strap comprises a plurality of locking holes arranged one after another close to the first end.

18. The belt according to claim 3, wherein the strap comprises a plurality of locking holes arranged one after another close to the first end.

19. The belt according to claim 4, wherein the strap comprises a plurality of locking holes arranged one after another-close to the first end.

20. The belt according to claim 12, wherein the first portion of the second fastening element is connected to the main body by a connecting portion, a projection of the connecting portion on the first face of the main body subtending an area which is less than an area subtended by the projection of the first portion on the first face.

* * * * *